US007206533B2

(12) United States Patent
Kwon

(10) Patent No.: US 7,206,533 B2
(45) Date of Patent: Apr. 17, 2007

(54) METHOD FOR CONTROLLING FUSING TEMPERATURE AND BLOWER SPEED BASED ON TONER COVERAGE COMPUTED FROM DATA TO BE PRINTED AND APPARATUS USING THE SAME

(75) Inventor: Gu-Dal Kwon, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 49 days.

(21) Appl. No.: 10/980,169

(22) Filed: Nov. 4, 2004

(65) Prior Publication Data

US 2005/0265742 A1 Dec. 1, 2005

(30) Foreign Application Priority Data

May 31, 2004 (KR) ..... 10-2004-0038858

(51) Int. Cl.
*G03G 21/20* (2006.01)

(52) U.S. Cl. ..... 399/92; 399/69

(58) Field of Classification Search ..... 399/67, 399/69, 91, 92, 93, 250, 251
See application file for complete search history.

(56) References Cited

U.S. PATENT DOCUMENTS

| | | | | |
|---|---|---|---|---|
| 5,109,255 | A | 4/1992 | Nishikawa et al. | 355/285 |
| 5,402,211 | A | 3/1995 | Yoshikawa | 355/285 |
| 5,631,800 | A | 5/1997 | Jin et al. | 361/103 |
| 5,708,938 | A | 1/1998 | Takeuchi et al. | 399/250 |
| 5,742,865 | A | 4/1998 | Yajima et al. | 399/43 |
| 6,011,938 | A | 1/2000 | Toizumi | 399/69 |
| 6,148,163 | A | 11/2000 | Ito | 399/67 |
| 6,577,833 | B2 | 6/2003 | Takahashi et al. | 399/250 |
| 6,934,486 | B2 * | 8/2005 | Lee | 399/92 |
| 2002/0146256 | A1 | 10/2002 | Sekiguchi et al. | 399/82 |

FOREIGN PATENT DOCUMENTS

| | | | |
|---|---|---|---|
| JP | 10-288911 | | 10/1998 |
| JP | 10307527 | A * | 11/1998 |
| JP | 11-098359 | | 4/1999 |
| JP | 2002-218229 | | 8/2002 |
| JP | 2003-112428 | | 4/2003 |
| JP | 2004-046615 | | 2/2004 |
| JP | 2004294651 | A * | 10/2004 |

* cited by examiner

*Primary Examiner*—David Gray
*Assistant Examiner*—Laura K Roth
(74) *Attorney, Agent, or Firm*—Roylance, Abrams, Berdo & Goodman, L.L.P.

(57) ABSTRACT

A method for controlling the fusing temperature and blower speed based on toner coverage computed from data to be printed and apparatuses using the same. The apparatus for controlling a fusing temperature based on a computed toner coverage has a memory for storing a reference fusing temperature by toner coverage, a fusing temperature determining part for computing the toner coverage of the data, and determining the temperature corresponding to the computed toner coverage about the reference temperature, and a heater. The apparatus for controlling of blower speed based on a computed toner coverage has a memory for storing a reference blower speed by toner coverage, a blower speed determining part for computing the toner coverage of the data, and determining the speed corresponding to the computed toner coverage about the reference speed, and a driver for varying the blower speed to the determined blower speed.

13 Claims, 5 Drawing Sheets

METHOD FOR CONTROLLING FUSING TEMPERATURE AND BLOWER SPEED BASED ON TONER COVERAGE COMPUTED FROM DATA TO BE PRINTED AND APPARATUS USING THE SAME

CROSS-REFERENCE TO RELATED APPLICATION

This application claims the benefit under 35 U.S.C. §119 (a) of Korean Patent Application No. 2004-38858 filed May 31, 2004, in the Korean Intellectual Property Office, the entire disclosure of which is incorporated herein by reference.

BACKGROUND OF THE INVENTION

1. Field of the Invention

The present invention relates to a temperature control apparatus for a fuser unit, a fan speed control apparatus for a carrier vapor processing unit, for use in an image forming apparatus, and a control method and an image forming apparatus using the same. More particularly, the present invention relates to a temperature control apparatus and a fan speed control apparatus, one for controlling a fuser temperature of a fuser unit, and the other for controlling the rotating speed of the carrier vapor processing unit in accordance with the toner coverage of the data.

2. Description of the Related Art

Generally, an image forming apparatus such as a laser beam printer (LBP), a photocopier and a facsimile, uses an electrophotographic printing method. The electrophotographic printing includes several consecutive processes, which include electrification, light exposure, development, image transfer and fusing.

FIG. 1 shows an engine mechanism of a general LBP as one example of the wet-type image forming apparatus, which adopts the electrophotographic printing method. A sheet of paper for printing is picked up by a pickup roller 108, fed along a paper conveyance path 130, printed and discharged out. The printing process will be described in detail below.

A photosensitive drum 100 is electrified by a charger 101 and therefore, electric potentials are evenly formed over the surface of the photosensitive drum 100. As the surface of the photosensitive drum 100 is exposed to a laser scanner unit (LSU) (not shown), an electrostatic latent image is formed thereon. The electrostatic latent image of the photosensitive drum 100 is then developed by a developer such as a toner which is supplied from a developer unit 106 including a developing roller 106*a* and a feeding roller 106*b*, into a visible image. The toner on the photosensitive drum 100 is then transferred onto a sheet of paper, which is fed from a paper cassette 109 by a transfer unit 102. The toner is fixed onto the paper by a fuser unit 303 which includes a heating roller 301 and a pressure roller 302. After the image fusing, the printed paper is discharged out.

The carrier vapor processing unit 400 operates to treat the carrier vapor (v) generated from the fusing unit 300 into a harmless substance.

In an image forming apparatus having the LBP as described above, the inner structure of the heating roller 301 of the fusing unit 300 is in a tubular form, and a heater lamp for generating heat is disposed inside the tubular heating roller 301. For the optimum fusing operation, the fusing unit 300 needs to maintain a uniform and appropriate temperature with the minimum electric power.

The carrier vapor processing unit 400 is additionally provided with a blower which forcibly blows the carrier vapor (v) from the fusing unit 300. Again, it is preferable that the blower generates an appropriate degree of airflow to maintain the proper temperature while using the minimum amount of electrical power.

Many efforts were made on the improvement of the fusing temperature control apparatus. For example, U.S. Pat. No. 5,109,255 entitled "Temperature control system" discloses a temperature control system for use in an electrophotograhic image forming apparatus, which is capable of maintaining the temperature of the fuser at a constant temperature during the printing, and maintaining the temperature of the fuser at a lower degree during non-printing operation.

U.S. Pat. No. 6,011,938 entitled "Fixing device in image forming device" discloses an image forming apparatus, which can maintain the fusing temperature to lower than an initial temperature to prevent overheating, when the fusing operation is continuously performed. U.S. Pat. No. 5,742,865 entitled "Apparatus for controlling temperature of fixing device by increasing the temperature for each sheet of a continuous fixing operation" discloses a temperature controlling apparatus, which controls the temperature for a fusing operation in accordance with the dimensions such as thickness and width of the printing paper.

U.S. Pat. No. 6,148,163 entitled "Control speed and fuser temperature based upon monochromatic or full-color printing" determines whether the image data is color or monochromatic data, and maintains the fuser temperature at a higher temperature when the image data is monochromatic.

U.S. Patent Publication US 20020146256 entitled "Fixing device, method for temperature control of the same, and method for manufacturing rollers of the same" controls the temperature of the heating roller of the fusing device to rapidly reach a predetermined temperature. The entire disclosures of the above-mentioned U.S patents and publication are incorporated herein by reference.

Conventionally, a fuser temperature controlling apparatus and a carrier vapor apparatus do not take the amount of image data into account, and it is inefficient in terms of power consumption. Therefore, a fuser temperature controlling apparatus and a carrier vapor processing apparatus for use in an image forming apparatus, which provide efficient power consumption, is required.

SUMMARY OF THE INVENTION

Accordingly, the present invention has been made to solve the above-mentioned problems occurring in the related art, and an object of the present invention is to provide a controlling apparatus and a method thereof, which is capable of controlling the fusing temperature of a fuser in an image forming apparatus in accordance with the toner coverage of a predetermined image data area and therefore, providing an improved efficiency in power consumption.

It is another object of the present invention to provide a controlling apparatus and a method thereof for use in an image forming apparatus, which is capable of controlling a speed of the blower of a carrier vapor processing apparatus in accordance with the toner coverage of a predetermined image data area and therefore, providing an improved efficiency in power consumption.

It is yet another object of the present invention to provide an image forming apparatus which is capable of controlling the temperature of a fusing apparatus and the speed of the blower in a carrier vapor processing apparatus in accordance with the toner coverage of a predetermined image data area.

The above aspects and/or other features of the present invention can substantially be achieved by providing an apparatus for controlling a fusing temperature of a fusing apparatus in an image forming apparatus forming an image on a printing medium according to the data received from a host. The apparatus for controlling the fusing temperature comprises a memory for storing therein a reference fusing temperature in accordance with the toner coverage of a certain area of the received data, a fusing temperature determining part for computing the toner coverage of the certain area of the received data, and determining the fusing temperature corresponding to the computed toner coverage with reference to the reference fusing temperature stored in the memory, and a heating part, under control of the fusing temperature determining part, for varying the temperature of the fusing apparatus to the determined fusing temperature.

The fusing temperature determining part may preferably include a data converter for converting the received data into pixel data, and a counter for counting a number of dots in the certain area of the converted pixel data and therefore computing the toner coverage.

The counter may receive a periodical pulse signal having rising and falling edges such that the counter start the counting with the pulse signal on the rising edge and completes the counting with the pulse signal on the falling edge.

The heating part may preferably include a power supply for providing power to the fusing apparatus, and a switching part for switching on and off the power supplied from the power supply to the fusing apparatus.

According to one aspect of the present invention, a method for controlling the fusing temperature of a fusing apparatus in an image forming apparatus for forming an image on a printing medium based on the data received from a host, is provided. The method for controlling the fusing temperature may include the steps of preparing a reference fusing temperature in accordance with a toner coverage of certain area of the received data, computing the toner coverage in the certain area of the received data, determining the fusing temperature, which corresponds to the computed toner coverage, based on the prepared reference fusing temperature, and heating the fusing apparatus to the fusing temperature obtained from the fusing temperature determining step.

The fusing temperature determining step may include the steps of converting the code data into pixel data, and counting a number of dots in the certain area of the converted pixel data and therefore computing the toner coverage. Accordingly, a fusing temperature corresponding to the number of dots counted in the counting step, can be determined with reference to the prepared reference fusing temperature.

In the counting step, a periodical pulse signal having rising and falling edges may be inputted such that the counting starts with the pulse signal at the rising edge and completes with the pulse signal at the falling edge.

According to another aspect of the present invention, an image forming apparatus for forming an image on a printing medium based on the data received from a host is provided. The image forming apparatus may include a developing device for forming a toner image on a photosensitive drum, a transfer device for transferring the toner image from the photosensitive drum onto the printing medium, a fusing device for fusing the toner image onto the printing medium, and a fusing temperature controlling device for controlling the fusing temperature of the fusing apparatus. The fusing temperature controlling device controls the fusing temperature in accordance with the toner coverage computed from data received from a host.

According to yet another aspect of the present invention, an apparatus for controlling a blower speed of a carrier vapor processing device, which processes carrier vapor (v) generated from a fusing apparatus of an image forming apparatus when forming an image onto a printing medium based on data received from a host, can be provided. The apparatus for controlling the blower speed may include a memory for storing therein a reference blower speed in accordance with a toner coverage of a certain area of the received data, a blower speed determining part for computing the toner coverage of the certain area of the received data, and determining a blower speed corresponding to the computed toner coverage with reference to the reference blower speed stored in the memory, and a driving part for, under control of the blower speed determining part, varying the speed of the blower according to the determined blower speed.

The blower speed determining part may include a data converter for converting the received data into pixel data, and a counter for counting a number of dots of a certain area of the converted pixel data and therefore computing the toner coverage.

The counter may receive a periodical pulse signal having rising and falling edges such that the counter can preferably start the counting with the pulse signal on the rising edge and completes the counting with the pulse signal on the falling edge.

The driving part may include a motor for driving the blower, a power supply for providing power to the motor, and a switching part, controlled by the blower speed determining part, for switching the power supplied from the power supply on/off to the motor.

According to yet another aspect of the present invention, a method for controlling a blower speed of a carrier vapor processing device, which processes carrier vapor (v) generated from a fusing apparatus of an image forming apparatus when forming an image onto a printing medium based on the data received from a host, is provided. The method for controlling the blower speed may include preparing a reference blower speed in accordance with a toner coverage of a certain area of the received data, computing the toner coverage in a certain area of the received data, determining a speed of a blower corresponding to the computed toner coverage, with reference to the prepared reference blower speed, and driving the blower to the various blower speeds determined during the blower speed determining step.

The blower speed determining step may include converting the received data into pixel data, and counting a number of dots in the certain area of the converted pixel data and therefore computing the toner coverage.

In the counting step, a periodical pulse signal having rising and falling edges may be inputted such that the counting starts with the pulse signal at the rising edge and completes with the pulse signal at the falling edge.

According to yet another aspect of the present invention, an image forming apparatus for forming an image onto a printing medium based on the data received from a host, is provided. The image forming apparatus may include a developer device for forming a toner image on a photosensitive drum, a transfer device for transferring the toner image from the photosensitive drum onto the printing medium, a fusing device for fusing the toner image onto the printing medium, a carrier vapor processing device for processing a carrier vapor (v), which is generated from the fusing device, and a blower speed controlling device, for controlling the blower speed of the carrier vapor processing device. The blower speed controlling device controls the blower speed of the carrier vapor processing device in accordance with the toner coverage computed from data received from a host.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE EXEMPLARY EMBODIMENTS

Figure 1:
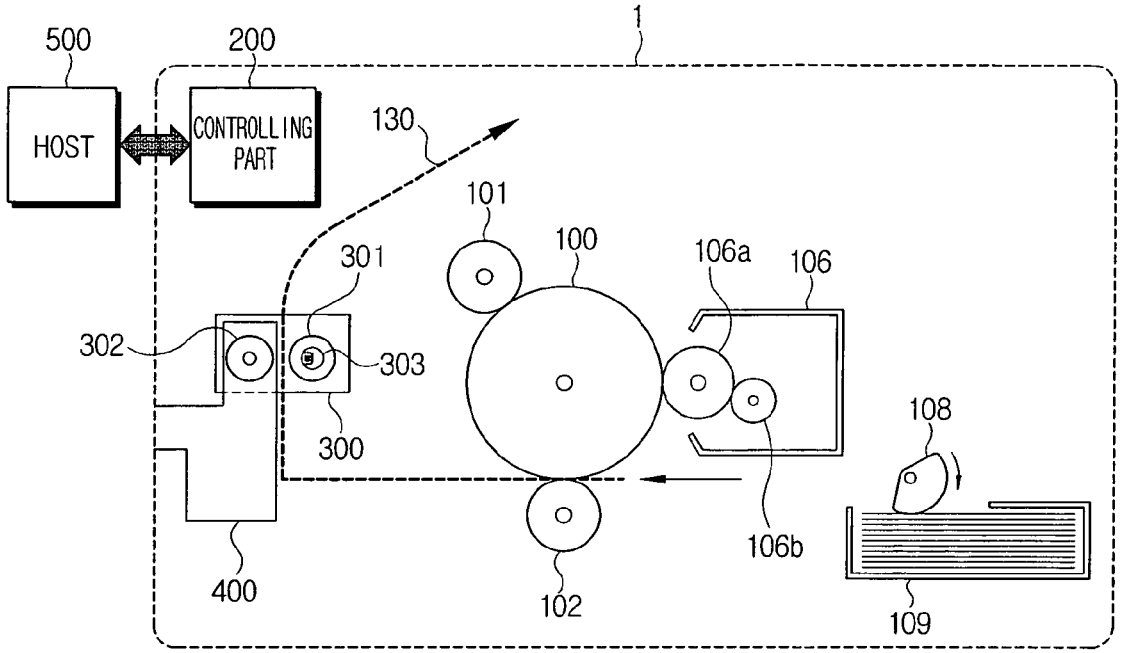
FIG. 1 (PRIOR ART)
FIG. 1 partially illustrates a block diagram of a conventional image forming apparatus.

Certain embodiments of the present invention will be described in greater detail with reference to the accompanying drawings.

In the following description, the same drawing reference numerals are used for the same elements throughout the drawings. The matters defined in the description such as a detailed construction and elements are provided to assist in a comprehensive understanding of the invention. Thus, it is apparent that the present invention can be carried out without those defined matters. Also, well-known functions or constructions are not described in detail for the sake of clarity.

Figure 2:
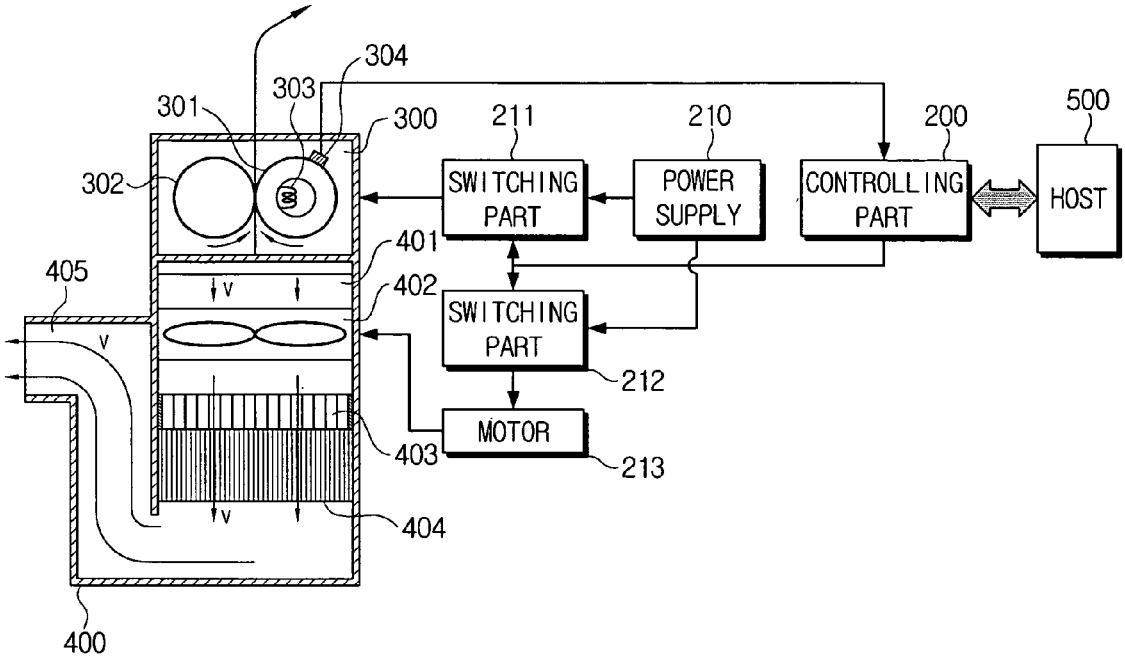
FIG. 2 partially shows a block diagram of an image forming apparatus having a controlling part therein in accordance with an embodiment of the present invention.

FIG. 2 partially shows a block diagram of an image forming apparatus having a controlling part therein in accordance with an embodiment of the present invention.

Referring to FIG. 2, an image forming apparatus 1 according to this embodiment includes a controlling part 200, a fusing apparatus 300, a carrier vapor processing device 400, a power supply 210, switching parts 211 and 212, and a motor 213.

The controlling part 200 receives data from a host 500, computes toner coverage, controls the fusing temperature of the fusing apparatus 300, and controls the speed of the blower for the carrier vapor processing device 400 based on the result of the computation of toner coverage.

The fusing apparatus 300 includes a heating roller 301 and a pressing roller 302. The heating roller 301 operates to fix the developer image onto the printing paper or other suitable medium with heat. A heat radiating body 303 is mounted inside the heating roller 301 to transform the electric energy supplied from the power supply 210 into heat energy.

Preferably, a direct current (DC) heating lamp may be used as the heat radiating body 303. In a preferred embodiment, the power supply 210, which supplies power to the heat radiating body 303, may use alternating current (AC) power.

A temperature sensor 304 is mounted on the outside of the heating roller 301 to detect the temperature as the heating roller 301 is heated by the heat radiating body 303. A thermistor may preferably be used as the temperature sensor 304.

The pressing roller 302 is preferably mounted to rotate in contact with the heating roller 301, and operates to fix the developer image onto the printing paper or other suitable medium. Both the heating roller 301 and the pressing roller 302 rotate in the direction shown by the arrows.

The switching part 211 turns on and off the power supplied from the power supply 210 to the heat radiating body 303. The controlling part 200 controls the turning on and off of the switching part 211.

The power supply 210 and the switching part 211 operate as a heating part, which varies the fusing temperature of the fusing apparatus 300 under the control of the controlling part 200.

The carrier vapor processing device 400 removes the inflammable hydrocarbon gas from the carrier vapor (v) which is generated from the fusing apparatus 300. The carrier vapor processing device 400 is an oxidation device, which can decompose the carrier vapor (v) into water and carbon dioxide by using a proper catalyst. The carrier vapor processing device 400 includes a blower 402, a heater 403, a duct 401 an oxidant body 404, and a carrier vapor discharge part 405.

The duct 401 is preferably connected to a side of the fusing apparatus 300 and guides the carrier vapor (v) generated from the fusing apparatus 300 to the oxidant body 404 to clean the carrier vapor (v). The blower 402 is mounted inside the duct 401, to forcibly blow the carrier vapor (v) of the fusing apparatus 300 to the oxidant body 404. The heater 403 raises the temperature of the carrier vapor (v) to an activation temperature such as approximately 200° C. The oxidant body 404 carries therein an oxidation catalyzer such as a platinum (Pt) or palladium (Pd), and is mounted at a rear end of the heater 403. After being processed as explained above, the carrier vapor (v) is discharged through the carrier vapor discharge part 405. As for the carrier vapor processing device, an example is shown in U.S. Pat. No. 5,708,938 entitled "Wet process image forming apparatus and carrier vapor collecting device therefore", the entire disclosure of which is incorporated herein by reference.

The switching part 212 turns on and off the power supplied from the power supply 210 to the motor 213. The controlling part 200 controls the turning on and off of the switching part 212.

In this particular example of the present invention, the power supply 210, the switching part 212 and the motor 213 operate as a driving part, which varies the speed of the blower of the carrier vapor processing device under the control of the controlling part 200. As for the technical background for driving the exemplary blower, the reference is made to U.S. Pat. No. 5,631,800 entitled "Apparatus for determining operating state of cooling fan", the entire disclosure of which is incorporated herein by reference.

FIG. 2 particularly shows a wet process image forming apparatus in which the controlling part 200 controls both the fusing temperature of the fusing apparatus 300 and the blower speed of the carrier vapor processing device 400. Alternatively, the controlling part 200 may operate to control either the fusing temperature of the fusing apparatus 300 or the speed of the blower of the carrier vapor processing device 400. As for the technical background of an exemplary wet process image forming apparatus, reference is made to U.S. Pat. No. 6,577,833 entitled "Image forming apparatus using liquid developer", the entire disclosure of which is incorporated herein by reference.

Figure 3:
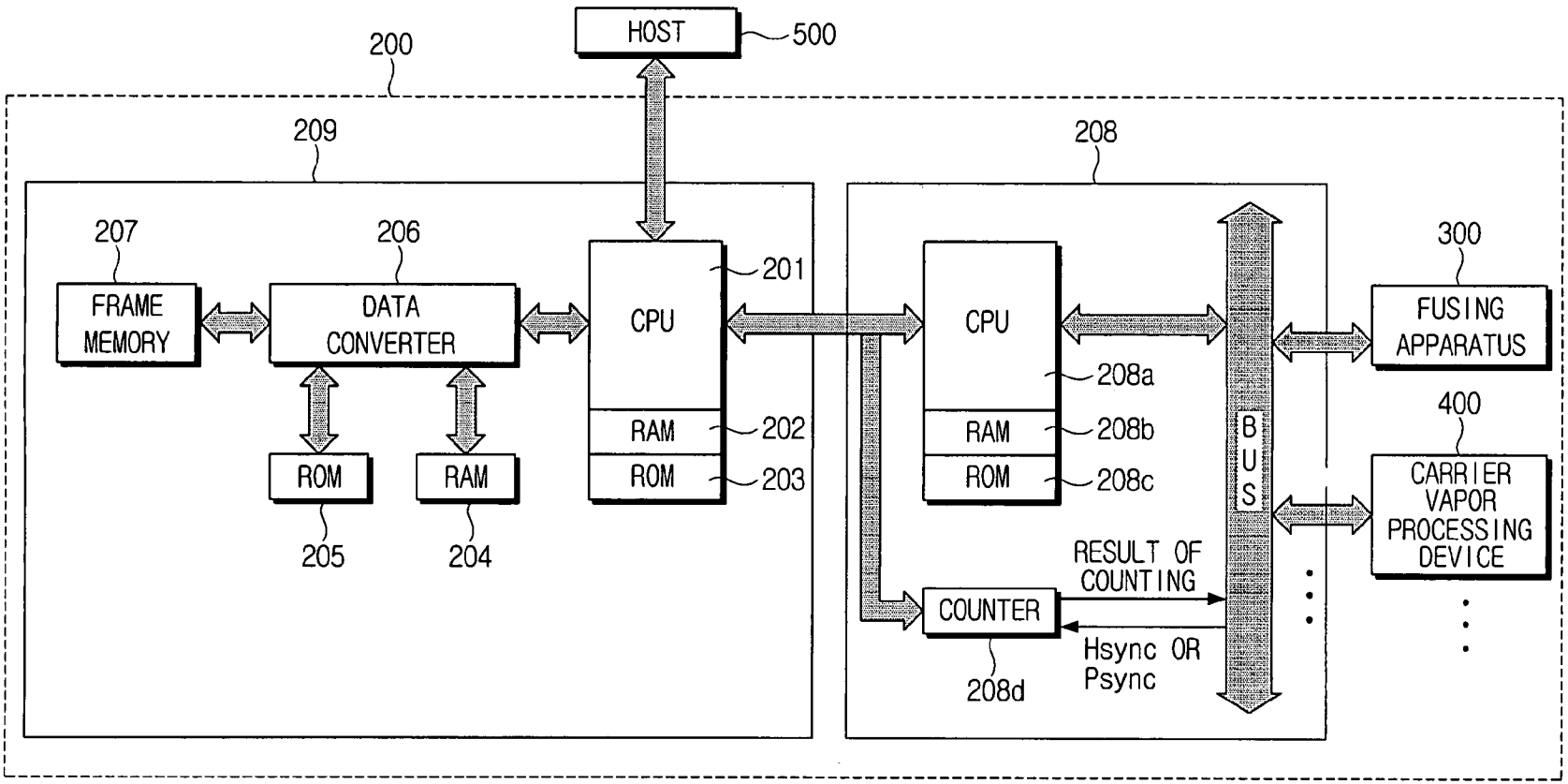
FIG. 3 is a block diagram of an electrical arrangement of the controlling part of FIG. 2.

FIG. 3 is a block diagram showing an electrical arrangement of the controlling part 200 of FIG. 2 according to an embodiment of the present invention.

Referring to FIG. 3, the controlling part 200 includes components indicated by reference numerals 201 through 207, and an engine controlling device 208. Those skilled in the art sometimes divide the controlling part 200 in terms of function thereof, into a video controller 209, which corresponds herein to the components 201 through 207 and an engine controller, which corresponds herein to the engine controlling device 208. In the execution of control programs stored in the ROM 203, coded image information (hereinbelow, 'code data') is received from an external device 500 such as a host computer. The received code data is input to a data conversion part 206, and the data conversion part 206 stores the input coded data to the ROM 204 and interprets the stored data. The external device 500 may perform a variety of setting operations with respect to the controlling part 200.

The RAM 202 is preferably used as a register. The ROM 203 stores therein font data which corresponds to the code data. The font data corresponding to the code data is read out from the ROM 203, and converted into video data comprising dots. The data after conversion (hereinbelow, 'pixel data') is stored in a frame memory 207.

When one page of the video data is stored in the frame memory 207, the CPU 201 outputs a print command to the engine controller 208, and outputs the video data stored in the frame memory 207 to the engine controller 208.

The engine controller 208 exchanges signals with the CPU 201, and accordingly controls the respective components of the image forming apparatus. For example, the engine controller 208 control a variety of operations such as paper size detection, detection as to whether the paper is present in the paper feeder, controlling the developing apparatus, transfer apparatus, fusing apparatus, and carrier vapor processing device. In this particular example, the engine controller 208 includes a CPU 208*a*, a RAM 208*b*, a ROM 208*c*, and a counter 208*d*.

The CPU 208*a* transmits and receives a variety of signals, including the pixel data received from the CPU 201 of the video controller 209. The ROM 208*c* stores therein the control programs of the engine controller 208. The counter 208*d* receives one page of pixel data from the CPU 201 of the video controller 209, and counts the number of dots for forming an image in one page. Alternatively, the counter 208*d* may count the number of dots per line, by one third of one page, or by (n) pages. The counter 208*d* may preferably count the number of dots by using Hsync signal or Psync signal. This will be described in detail below with reference to FIGS. 5A and 5B.

The counted result of the counter 208*d* is transmitted to the CPU 208*a*, and the CPU 208*a*, based on the counted result, computes a toner coverage of the pixel data received from the CPU 201. The toner coverage refers to the amount of toner, which is attached to the printing paper. The amount of toner may be expressed by the units such as % coverage, or number of dots. For example, 50% toner coverage indicates that toner is attached to 50% of the image area on average. If the toner amount is expressed in the unit of dots, assuming that the image is formed on an A4 paper (210×297 mm) which has 4722 dots per line and 6778 lines per page the maximum, 2361 dots per line indicates that toner is attached to the half of the line on average. Essentially the 'toner coverage' gives information on the amount of toner formed on a certain area. The certain area may be, inter alia, three pages, two pages, one page, half page, and one-third of one page. In this description, the 'toner coverage' refers to the amount of toner, which is expressed by either the number of dots or % coverage. For example, % toner coverage per page can be computed by the following mathematical formula 1, and % toner coverage by one-third of one page can be computed by the following mathematical formula 2:

% toner coverage=[(number of dots counted during the pulse interval of Psync signal)/(maximum number of dots per page)]×100 [Mathematical formula 1]

% toner coverage=[(number of dots counted during one-third of pulse interval of Psync signal)/(maximum number of dots of one-third of one page)]×100 [Mathematical formula 2]

wherein, the maximum number of dots per page is determined by {maximum number of dots per line}×(maximum number of lines per page). Assuming that A4 printing paper is used, the maximum number of dots per line is 4722 and the maximum number of lines per page is 6778; therefore, the maximum number of dots per page can be 4722×6778=32005716.

The RAM 208*b* may store therein a lookup table such as the one shown below. In the following exemplary lookup table, there are four items including the first and second items of reference toner coverage, the third item of fusing temperature and the fourth item of blower speed. Alternatively, the RAM 208*b* may use the table including first, third and fourth items only. Or, the RAM 208*b* may use a lookup table including the first and the third items, or first and the fourth items.

TABLE 1

| Item 1 Number of dots | Item 2 % coverage | Item 3 Reference fusing temperature | Item 4 Reference blower speed |
|---|---|---|---|
| Less than $N_T \times 0.2$ | Less than 20(%) | T1 | V1 |
| $N_T \times 0.2$ or greater and less than $N_T \times 0.4$ | 20(%) or greater and less than 40(%) | T2 | V2 |
| $N_T \times 0.4$ or greater and less than $N_T \times 0.6$ | 40(%) or greater and less than 60(%) | T3 | V3 |
| $N_T \times 0.6$ or greater and less than $N_T \times 0.8$ | 60(%) or greater and less than 80(%) | T4 | V4 |
| $N_T \times 0.8$ or greater | 80(%) or greater | T5 | V5 |

The above table is only one example of a lookup table, which can be constructed when one page of A4 printing paper is set as a certain area.

Generally, T1<T2<T3<T4<T5, V1<V2<V3<V4<V5, and NT denotes the maximum number of dots of one page of A4 printing paper, which is 4722×6778=32005716. One will easily understand that the optimum values of the reference fusing temperature (T1, T2, T3, T4, T5) and the reference blower speed (V1, V2, V3, V4, V5) can be obtained without undue experimentation.

The operation of the engine controller 200 for controlling the temperature of the fusing apparatus 300 will now be described.

The CPU 208*a* receives a counted result from the counter 208*d*, and reads out a lookup table from the RAM 208*b*. The CPU 208*d* compares the dot values of the first item of the lookup table with the counted result, and determines a matching dot value. The CPU 208*d* then determines the reference fusing temperature corresponding to the determined dot value to be the fusing temperature of the fusing apparatus 300. With the fusing temperature being determined as above, the CPU 208*d* varies the temperature of the fusing apparatus 300 through the bus and paths shown in FIG. 2.

As described above, with the fusing temperature controlling apparatus according to an embodiment of the present invention, temperature control is enabled not only in the page unit, but also in a variety of unit areas even in a single printing page. U.S. Pat. No. 5,402,211 entitled "Heated fixing roller with selectively heatable portions" discloses a technique which can control the temperature of the heating roller at varying degrees not only in the circumferential direction, but also in the direction parallel to the axis of the heating roller, the entire disclosure of which is incorporated herein by reference.

Similar to the above, the engine controller 200 controls the carrier vapor processing device 400. That is, the CPU 208*a* receives a counted result from the counter 208*d* and reads out a lookup table from the RAM 208*b*. The CPU 208*a* compares the dot values of the first item of the lookup table with the counted dot value, and determines a matching dot value. Based on the matching dot value, the CPU 208*d* determines the corresponding reference blower speed to be the current speed of the blower. Accordingly, the CPU 208*a* variably controls the speed of the blower in accordance with such determined blower speed through the bus and the paths as shown in FIG. 2.

Figure 5A:
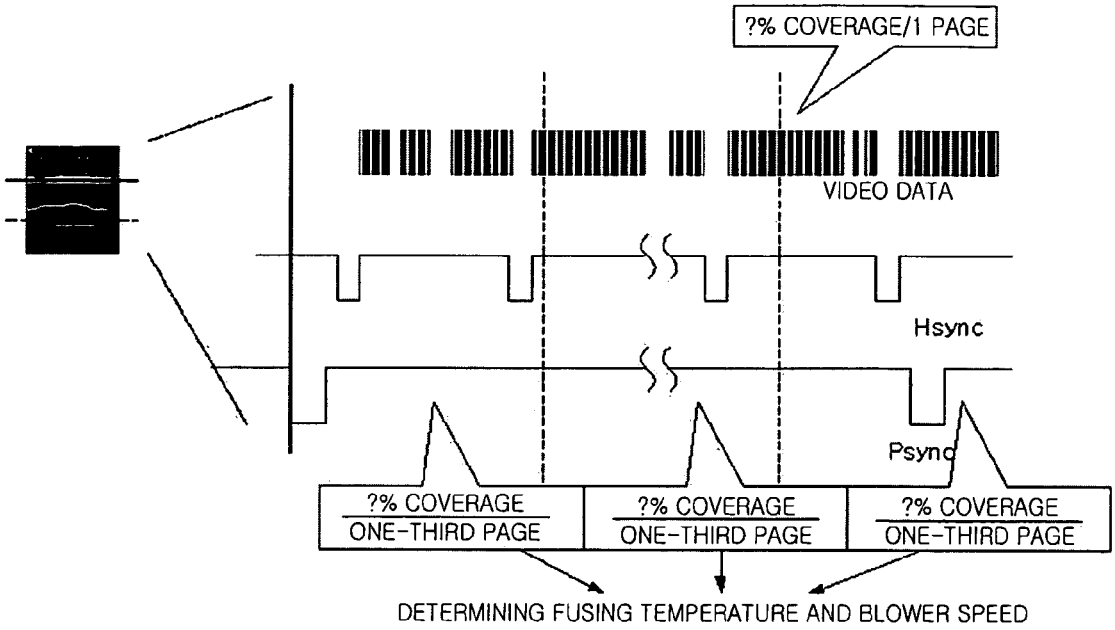
FIGS. 5A and 5B show the counting operation of a counter according to an embodiment of the present invention.
Figure 5B:
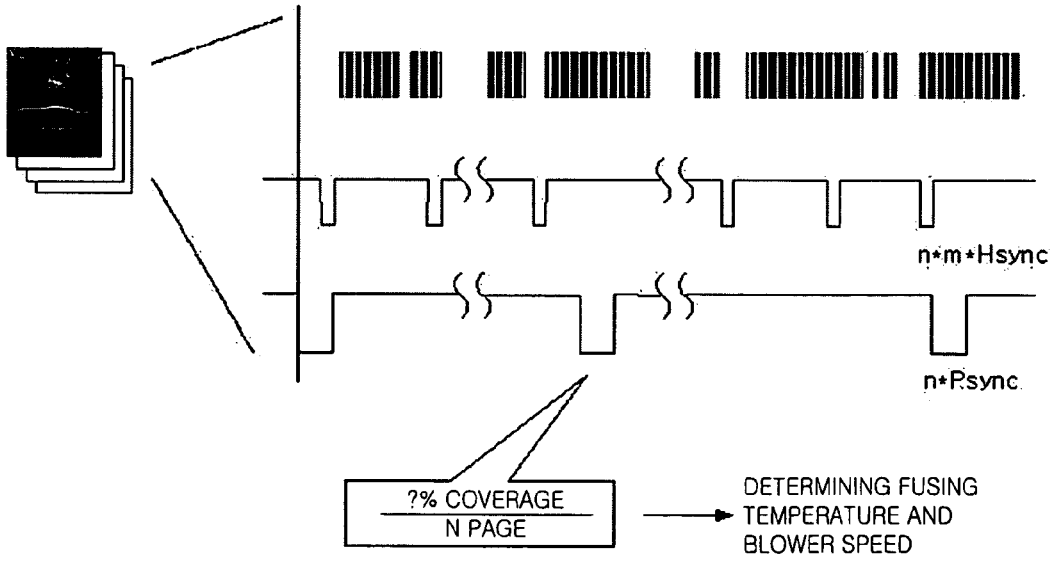

FIGS. 5A and 5B show the concept of the counter 208*d* counting the pixel data. Referring to FIGS. 3, 5A and 5B, the pixel data counting by the counter 208*d* will be described below. As described above, the counter 208*d* receives pixel data from the video controller 209 and counts the number of dots. In one embodiment, the pixel data may be digital data consisting of "0"s and "1"s. If "1" indicates dot, then the counter 208*d* counts the number of "1"s, and therefore counts the number of dots in the received pixel data.

An embodiment of the present invention, either the Hsync signal or the Psync signal may be used to control start and end of the counting operation. The Hsync signal is generated from a light scanning unit (LSU) (not shown) which forms an electrostatic latent image on the photosensitive drum 100. As shown in FIG. 5A, the Hsync signal consists of periodical pulses at constant intervals, with the intervals between the pulses corresponding to one line of the pixel data. For example, if the Hsync signal is used as a signal indicating start and end of the counting, the counter 208*d* may start the counting with the Hsync pulse at the rising edge, and stops the counting and outputs the counted results to the CPU 208*a* with the Hsync pulse at the falling edge. As a result, when the Hsync signal is used as the control signal, the counted result from the counter 208*d* will be the number of dots included in the pixel data, which corresponds to one line. As shown in FIG. 5A, the toner coverage per one-third of the page is computed, and the fusing temperature and the speed of the blower are controlled in accordance with such computed toner coverage.

Alternatively, the counter 208*d* may use the Psync signal as a control signal. Psync signal is generated from the engine controller 208, and as shown in FIG. 5B, consists of periodical pulses at constant intervals, with the intervals between the pulses corresponding to one page of pixel data. Similar to the case of using the Hsync signal as a control signal, the counter 208*d* using the Psync signal as a control signal may start the counting with the Psync pulse at a rising edge, and stop the counting with the Psync pulse at a falling edge. As a result, the counted result from the counter 208*d* will be the number of dots of one page of pixel data. FIG. 5B shows one example where (n) pages are determined as the certain area. In this example, the toner coverage of (n) pages is computed and the fusing temperature and the speed of the blower are controlled in accordance with the computed result of toner coverage. Here, 'm' refers to the number of lines per page, and n×Psync(=n×m×Hsync) refers to the counting time.

The control signal used by the counter 208*d*, that is, the periodical pulse signal such as the Hsync or the Psync signal can be determined by the user at the hardware level.

The number of dots counted by the counter 208*d* is used for determining the fusing temperature of the fusing apparatus 300 and the speed of the blower.

In order to compute toner coverage, a target area for the computation of toner coverage has to be determined first, and hereinbelow, the target area will be referred to as a certain area. The certain area can be determined in accordance with the selection of the one who embodies the present invention, in the hardware level, firmware level, or software level.

The certain area is determined in the hardware level as follows. Assuming that the area corresponding to one page is determined to be the certain area, the counter 208*d* can use the Psync signal as the counting control signal. The counter 208*d* then outputs the result of counting in the unit of one page. In another example, the area corresponding to one-third of one page can be determined to be the certain area, and in this case, a periodical pulse signal having an interval between pulses of one-third as the interval between pulses of the Psync signal, can be used as the counting control signal. The counter 208*d* then outputs the result of the counting in the unit of one-third of the page, and therefore, the output result becomes the toner coverage corresponding to one-third of the page. Yet in another example, the area corresponding to (n) pages can be determined to be the certain area. In this case, a periodical pulse signal having an interval between pulses of (n) times as the interval between pulses of the Psync signal, can be used as the counting control signal.

Hereinbelow, the method of determining the certain area in the firmware level will be described in greater detail with reference to one example of the counter 208*d* using the Hsync signal as the counting control signal. The designer may determine if one-third of a page should be the certain area, by storing in the ROM 208*c* a proper function f(x) which is expressed by f(x)=x×(maximum number of lines per page/3). For instance, the maximum number of lines per page will be 6778 lines with respect to A4 printing paper.

The CPU 208*a* applies the result of counting from the counter 208*d* to the function f(x) read out from the ROM 208*c* and therefore, computes the result of the function f(x). The toner coverage can be computed by the CPU 208*a* by comparing the result of function f(x) with the lookup table pre-stored in the RAM 208*b* with respect to one-third of a page.

The method of determining the certain area in the software level will now be described below, with respect to one example in which the counter 208*d* uses Hsync signal as the counting control signal. The designer may determine an area corresponding to one-third of a page to be the certain area, by pre-storing a proper lookup table, for example, the lookup table shown below, in the RAM 208*b*.

TABLE 2

| Item 1 Number of dots | Item 2 % coverage | Item 3 Reference fusing temperature | Item 4 Reference blower speed |
|---|---|---|---|
| Less than $N_{T,L} \times 0.2$ | Less than 20(%) | T1 | V1 |
| $N_{T,L} \times 0.2$ or greater and less than $N_{T,L} \times 0.4$ | 20(%) or greater and less than 40(%) | T2 | V2 |
| $N_{T,L} \times 0.4$ or greater and less than $N_{T,L} \times 0.6$ | 40(%) or greater and less than 60(%) | T3 | V3 |
| $N_{T,L} \times 0.6$ or greater and less than $N_{T,L} \times 0.8$ | 60(%) or greater and less than 80(%) | T4 | V4 |
| $N_{T,L} \times 0.8$ or greater | 80(%) or greater | T5 | V5 |

The above table shows one example of lookup table which can be used when one-third of A4 printing paper is determined to be the certain area. Such a lookup table can be pre-stored in the RAM 208*b*. Generally, T1<T2<T3<T4<T5, V1<V2<V3<V4<V5, and NT, L is the maximum number of dots per line of A4 printing paper, which will be, as mentioned above, 4722 dots. Determining the toner coverage using the above table 2 will now be described. If the counter 208*d* uses the Hsync signal as the counting control signal, the counter 208*d* outputs the result of counting in the unit of lines, and therefore, the CPU 208*a* receives the result of the counting per line and accordingly determines the fusing temperature and the blower speed corresponding to the one-third of a page. To describe it in greater detail, among the results of counting output from the counter 208*d*, the CPU 208*a* selects only the result of the counting, which corresponds to the line from where one-third of a page begins. The CPU 208*a* compares the selected result of the counting with the first item of the lookup table, such as the table 2, and therefore, determines the fusing temperature and blower speed suitable for the one-third of a page area. Although, in this particular example, the CPU 208*a* selected only the result of the counting corresponding to the line where the one-third page beings, this should not be considered as limiting. Therefore, the CPU 208*a* alternatively selects only the result of the counting corresponding to the line where the one-third page area ends. Yet in another example, the CPU 208*a* may select only the result of the counting corresponding to a certain line of the one-third page.

One will understand that the present invention can appropriately be applied to the case when the image data is color data, for example, when the image data is for a composite color image of cyan, magenta, yellow and black (CMYK).

In this example, similar to the monochromatic data, the determination of fusing temperature or blower speed will follow the sequence of i) selecting a certain target area, ii) computing toner coverage of the selected certain area, and iii) determining a fusing temperature, or blower speed.

The certain area may be selected, for example, in the hardware level. Assuming that one A4 page is determined to be the certain area, four (4) counters are prepared to receive Psync counting control signals. The counters each receive C, M, Y and K data from the video controller 209. Each of the counters than counts the number of dots of the received data, and starts the counting from when the page begins and completes the counting when the one page ends. The number of dots counted is input into the CPU 208*a*. The CPU 208*a* adds up the received counted numbers of dots and averages the same, and therefore computes an average number of dots per page. The CPU 208*a* compares the computed average number of dots with the lookup table as shown in the above-mentioned table 1, which is read out from the RAM 208*b*. The CPU 208*a* determines the area the average number of dots belongs to in the look up table from which it determines the fusing temperature or the blower speed.

Adding three (3) more counters to the structure as shown in FIG. 3 may easily achieve the above process. The additional counters are wired in a similar manner as counter 208*d*.

Figure 4:
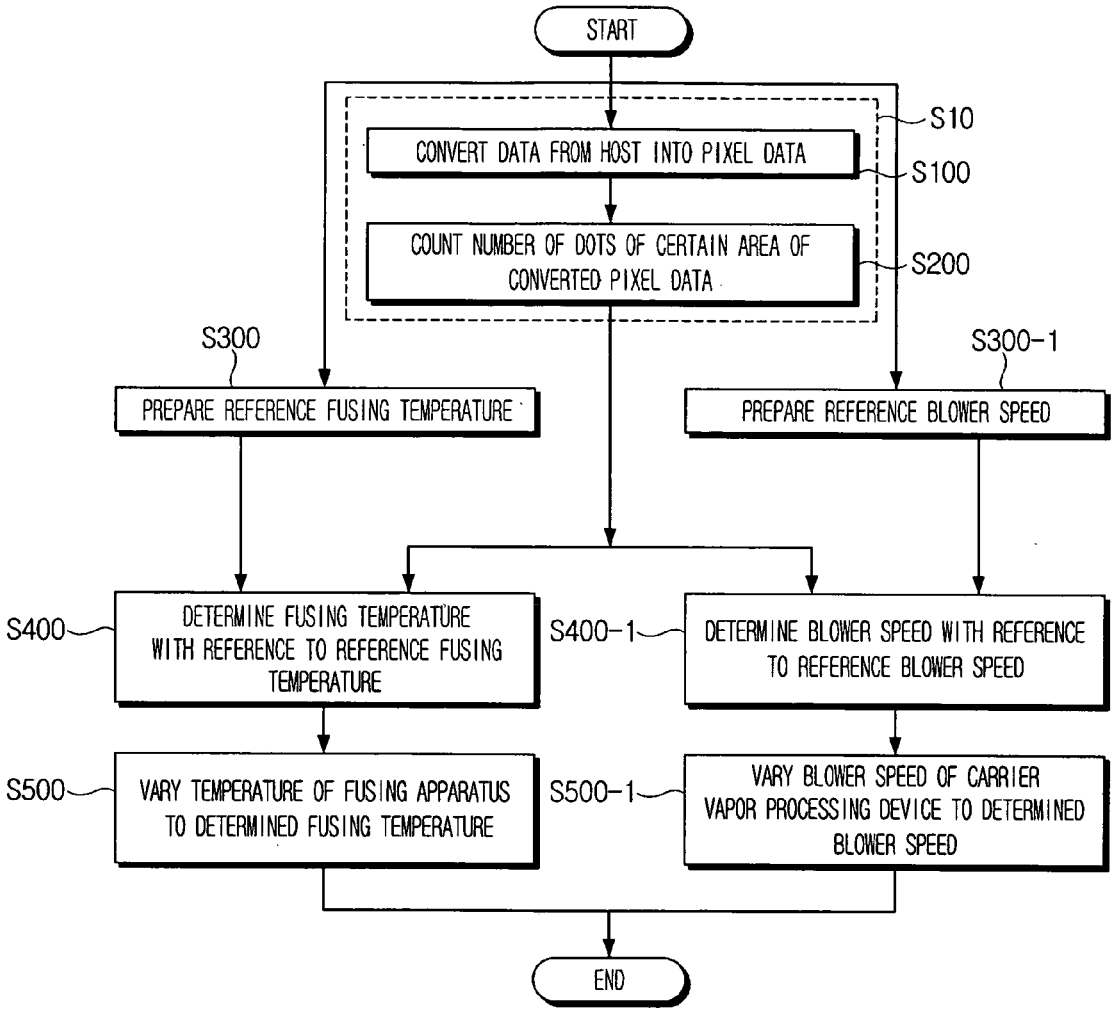
FIG. 4 is a flowchart of a method for controlling the temperature of the fusing apparatus and the speed of the blower of the fusing apparatus of FIG. 2.

FIG. 4 is the flowchart illustrating the temperature controlling method of the fusing apparatus 300 and the blower speed controlling method of the carrier vapor processing device as shown in FIG. 2.

Referring to FIG. 4, the temperature controlling method of the fusing apparatus 300 includes computing (S10) a toner coverage in a certain target area where the data is received from the host, preparing (S300) a reference fusing temperature, determining (S400) a fusing temperature corresponding to the toner coverage computed from the toner coverage computing step (S10) with reference to the reference fusing temperature provided from the step (S300) of preparing a reference fusing temperature, and heating (S500) to vary the fusing temperature to the temperature determined at the fusing temperature determining step (S400). In the similar manner, the blower speed controlling method of the carrier vapor processing device 400 includes computing (S10) a toner coverage of a certain area where the data is received from the host, preparing (S300-1) a reference blower speed, determining (S400-1) a blower speed corresponding to the toner coverage obtained from the toner coverage computing step (S10) with reference to the reference blower speed provided from the step (S300-1) of preparing the reference blower speed, and driving to vary (S500-1) the speed of the carrier vapor processing device to the blower speed determined in the blower speed determining step (S400-1). In one preferred example, the toner coverage computing step (S10) may include converting (S100) the received data from the host into pixel data, and counting (S200) the number of dots in the certain area of the converted pixel data.

The step (S100) of converting the received data from the host into pixel data specifically refers to the process in which a data converter converts code data into pixel data.

The step (S200) of counting specifically refers to a process in which the number of dots included in the certain area of the converted pixel data is counted. The certain area of the pixel data may be, for example, 3 pages, 2 pages, 1 page, a half page, one-third of the page. The counter may use the Psync signal when area corresponding to 1 page is determined to be the certain area of the pixel data. In the meantime, if the area corresponding to one line is determined to be the certain area, the counter may use the Hsync signal as the control signal.

The fusing temperature determining step (S400) and the blower speed determining step (S400-1), respectively, determines the fusing temperature and the blower speed by using the reference values stored by the CPU 208*a* in the RAM 208*b*.

The fusing temperature varying step (S500) and the blower driving step (S500-1) vary the fusing temperature and the blower speed by controlling the CPU 208*a* and the switching parts 211 and 212 based on the fusing temperature and the blower speed computed from the determining steps (S400, S400-1).

As described above in the exemplary embodiments of the present invention, a toner coverage is computed with respect to a certain target area of the input image data, and fusing temperature and the blower speed can be controlled in accordance with the computed toner coverage. As a result, power consumption can be greatly reduced.

The foregoing embodiment and advantages are merely exemplary and are not to be construed as limiting the present invention. Embodiments of the present invention can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. An apparatus for controlling a blower speed of a carrier vapor processing device, which processes carrier vapor generated from a fusing apparatus of an image forming apparatus when forming an image onto a printing medium based on data received from a host, the apparatus for controlling the blower speed comprising:

a memory storing therein a plurality of reference blower speeds in accordance with a toner coverage of a certain area of the received data;

a blower speed determining part for computing the toner coverage of the certain area of the received data, and determining a blower speed corresponding to the computed toner coverage with reference to the plurality of reference blower speeds stored in the memory; and a driving part for, under control of the blower speed determining part, varying the speed of the blower according to the determined blower speed.

2. The apparatus for controlling of claim 1, wherein the blower speed determining part comprises a data converter for converting the received data into pixel data, and a counter for counting a number of dots of a certain area of the converted pixel data and therefore computing the toner coverage.

3. The apparatus for controlling of claim 2, wherein the counter receives a periodical pulse signal having rising and falling edges such that the counter starts the counting with the pulse signal on the rising edge and completes the counting with the pulse signal on the falling edge.

4. The apparatus for controlling of claim 2, wherein the number of dots of the certain area of the converted pixel data and computed toner coverage is stored in a lookup table.

5. The apparatus for controlling of claim 1, wherein the driving part comprises:

a motor for driving the blower;

a power supply for providing power to the motor; and a switching part, controlled by the blower speed determining part, for on/off switching the power supplied from the power supply on and off to the motor.

6. The apparatus for controlling of claim 1, wherein the memory stores a lookup table.

7. A method for controlling a blower speed of a carrier vapor processing device which processes carrier vapor generated from a fusing apparatus of an image forming apparatus when forming an image onto a printing medium based on the data received from a host, the method for controlling the blower speed comprises:

storing a plurality of reference blower speeds in accordance with a toner coverage of a certain area of the received data;

computing the toner coverage in the certain area of the received data;

determining a speed of a blower corresponding to the computed toner coverage, with reference to the stored plurality of reference blower speeds; and driving the blower to the blower speed determined during the blower speed determining step.

8. The method for controlling of claim 7, wherein the blower speed determining step comprises:

converting the received data into pixel data; and counting a number of dots in the certain area of the converted pixel data and therefore computing the toner coverage.

9. The method for controlling of claim 8, wherein in the counting step, a periodical pulse signal having rising and falling edges is input such that the counting starts with the pulse signal at the rising edge and completes with the pulse signal at the falling edge.

10. The method for controlling of claim 7, wherein the plurality of reference blower speeds are stored in a lookup table in accordance with the toner coverage of the certain area of the received data.

11. An image forming apparatus for forming an image onto a printing medium based on data received from a host, the image forming apparatus comprising:

a developer device for forming a toner image on a photosensitive drum;

a transfer device for transferring the toner image from the photosensitive drum onto the printing medium;

a fusing device for fusing the toner image onto the printing medium;

a carrier vapor processing device for processing a vapor which is generated from the fusing device; and a blower speed controlling device for controlling the blower speed of the carrier vapor processing device, wherein the blower speed controlling device controls the blower speed of the carrier vapor processing device in accordance with a stored plurality of reference blower speeds and toner coverage computed from data received from a host.

12. An apparatus for controlling a blower speed of a carrier vapor processing device, which processes carrier vapor generated from a fusing apparatus of an image forming apparatus when forming an image onto a printing medium based on data received from a host, the apparatus for controlling the blower speed comprising:

a memory for storing therein a reference blower speed in accordance with a toner coverage of a certain area of the received data;

a blower speed determining part for computing the toner coverage of the certain area of the received data, and determining a blower speed corresponding to the computed toner coverage with reference to the reference blower speed stored in the memory; and a driving part for, under control of the blower speed determining part, varying the speed of the blower according to the determined blower speed;

wherein the blower speed determining part comprises a data converter for converting the received data into pixel data, and a counter for counting a number of dots of a certain area of the converted pixel data and therefore computing the toner coverage; and further wherein the counter receives a periodical pulse signal having rising and falling edges such that the counter starts the counting with the pulse signal on the rising edge and completes the counting with the pulse signal on the falling edge.

13. A method for controlling a blower speed of a carrier vapor processing device which processes carrier vapor generated from a fusing apparatus of an image forming apparatus when forming an image onto a printing medium based on the data received from a host, the method for controlling the blower speed comprises:

preparing a reference blower speed in accordance with a toner coverage of a certain area of the received data;

computing the toner coverage in the certain area of the received data;

determining a speed of a blower corresponding to the computed toner coverage, with reference to the prepared reference blower speed;

driving the blower to the blower speed determined during the blower speed determining step;

converting the received data into pixel data; and counting a number of dots in the certain area of the converted pixel data and therefore computing the toner coverage;

wherein in the counting step, a periodical pulse signal having rising and falling edges is input such that the counting starts with the pulse signal at the rising edge and completes with the pulse signal at the falling edge.

* * * * *